US009388502B2

(12) United States Patent
Iimori et al.

(10) Patent No.: US 9,388,502 B2
(45) Date of Patent: Jul. 12, 2016

(54) BUTTON OR FASTENER MEMBER OF COPPER-PLATED ALUMINUM OR ALUMINUM ALLOY AND METHOD OF PRODUCTION THEREOF

(75) Inventors: Masayuki Iimori, Tokyo (JP); Michael David Hopper, Lexington, KY (US)

(73) Assignee: YKK Corporation (JP)

( * ) Notice: Subject to any disclaimer, the term of this patent is extended or adjusted under 35 U.S.C. 154(b) by 355 days.

(21) Appl. No.: 13/547,781

(22) Filed: Jul. 12, 2012

(65) Prior Publication Data

US 2014/0017512 A1 Jan. 16, 2014

(51) Int. Cl.

| | |
|---|---|
| ***B32B 15/00*** | (2006.01) |
| ***C25D 7/02*** | (2006.01) |
| ***C25D 5/10*** | (2006.01) |
| ***C25D 17/16*** | (2006.01) |

(52) U.S. Cl.

CPC .. *C25D 7/02* (2013.01); *C25D 5/10* (2013.01); *C25D 17/16* (2013.01); *Y10T 24/36* (2015.01); *Y10T 428/1275* (2015.01)

(58) Field of Classification Search

None

See application file for complete search history.

(56) References Cited

U.S. PATENT DOCUMENTS

| | | | | |
|---|---|---|---|---|
| 2,891,309 | A * | 6/1959 | Fenster | 72/39 |
| 3,957,452 | A * | 5/1976 | Schaer et al. | 428/650 |
| 4,270,957 | A * | 6/1981 | Donakowski et al. | 134/2 |
| 4,316,778 | A * | 2/1982 | Whitehurst | 205/68 |
| 4,346,128 | A * | 8/1982 | Loch | 427/328 |
| 6,178,623 | B1 * | 1/2001 | Kitazawa et al. | 29/825 |
| 6,656,606 | B1 * | 12/2003 | Morin et al. | 428/652 |
| 2002/0100694 | A1 * | 8/2002 | Morin et al. | 205/170 |
| 2010/0167085 | A1 * | 7/2010 | Sun et al. | 428/650 |

FOREIGN PATENT DOCUMENTS

| | | |
|---|---|---|
| JP | 2240290 A | 9/1990 |
| JP | 5171451 A | 7/1993 |

OTHER PUBLICATIONS

CL-NC Alkaline Copper: the First-Ever Solution for Direct Plating on Aluminum, Uyemura International Corporation brochure, 4 pages. No date.*

Translation of JP 02-240290. Sep. 1990.*

CL-NC Alkaline Copper, Cyanide free Copper Plating Process, Uyemura USA, Nov. 2010, 3 pgs.

Dini et al., "Electrodeposition of Copper," Modern Electroplating, 2010, pp. 33-78.

* cited by examiner

*Primary Examiner* — Daniel J Schleis

(74) *Attorney, Agent, or Firm* — Kilpatrick Townsend & Stockton LLP

(57) ABSTRACT

A button or fastener member is provided wherein aluminum or an aluminum alloy is used as raw material, a first copper plating layer is formed directly over the entire surface of said raw material, and a second copper plating layer is formed directly on top of the first copper plating layer, with the aforementioned second copper plating layer being thicker than the aforementioned first copper plating layer.

13 Claims, 4 Drawing Sheets

BUTTON OR FASTENER MEMBER OF COPPER-PLATED ALUMINUM OR ALUMINUM ALLOY AND METHOD OF PRODUCTION THEREOF

FIELD OF THE INVENTION

This invention concerns a button or fastener member of copper-plated aluminum. Additionally, it concerns a production method for the aforementioned member.

BACKGROUND

There is known technology for directly forming copper plating on the surface of aluminum. For example, one method is described in Japanese Unexamined Patent Application Publication H2-240290 for directly copper-plating aluminum through pretreatment by alkali degreasing, washing with a surfactant, acid washing or water washing, followed by using a copper pyrophosphate plating bath containing 10-500 g/L phosphoric acid and/or a phosphate to perform plating at a current density of 0.1-2.0 A/dm$^2$, and then heat-treating the aluminum. Embodiment 1 of this publication describes the formation of a copper plating layer approximately 10 μm thick on an aluminum plate. This method allows for the formation of a uniform copper plating layer with very good adhesion between the aluminum substrate and copper plating, as well as an appealing appearance.

SUMMARY

Products in the button field are conventionally known to be surface-plated using brass as a base metal due to its superior platability. Products in the fastener field are known to be surface-plated using zinc as a base metal. In recent years, steep increases in the price of materials have posed a problem, in addition to a demand for lightweight buttons and fasteners. Therefore, the production of buttons and fasteners using aluminum, which is lightweight and relatively inexpensive, has been considered as a solution. However, because it is not possible to achieve a heavy-feeling or vintage appearance with aluminum, surface plating is desirable.

On the other hand, although aluminum allows for the formation of a strong oxide film on its surface, it is known as a hard to plate material. Thus, it is difficult to plate using the same methods as for brass and zinc. Therefore, generally zincate treatment using a zinc and aluminum substitution reaction is performed as pretreatment to improve the adhesion of the plating film and aluminum raw material. However, since zincate treatment involves chemical substitution, uniform zinc substitution treatment over an entire surface is difficult, as is control of the treatment solution.

On this point, a method for direct copper plating of an aluminum surface without zincate treatment is described in Japanese Unexamined Patent Application Publication H2-240290, but the method described in this publication is for still plating, and is not intended for mass production of small products such as buttons or fasteners. In addition, members in the button and fasteners fields require strength.

This invention was conceived out of consideration of the aforementioned facts, and one aspect consists of a button or fastener member wherein aluminum or an aluminum alloy is used as raw material, a first copper plating layer is formed directly over the entire surface of said raw material, and a second copper plating layer is formed directly on top of the first copper plating layer, with the aforementioned second copper plating layer being thicker than the aforementioned first copper plating layer.

In an embodiment of a button or fastener member based on this invention, the mean crystal grain size of the first copper plating layer is larger than the mean crystal grain size of the second copper plating layer.

In another embodiment of a button or fastener member based on this invention, the mean thickness of the first copper plating layer is 0.01-1.5 μm, while the mean thickness of second copper plating layer is 1.6-10 μm.

In a further embodiment of a button or a fastener member based on this invention, a final plating layer is formed in one layer, or two or more layers, on top of the second copper plating layer.

In a further embodiment of button or fastener member based on this invention, the overall thickness of the final plating layer is thinner than the total thickness of the first copper plating layer and second copper plating layer.

In a further embodiment of a button or fastener member based on this invention, the first copper plating layer and second copper plating layer are both formed by barrel plating.

Another aspect of this invention is a button or fastener equipped with a button or fastener member based on this invention.

A further aspect of this invention is a production method for a copper-plated button or fastener, consisting of: a first step to produce a semi-finished product for a button or fastener member by performing a forming process using aluminum or an aluminum alloy as raw material, a second step to form a first copper plating layer directly over the entire surface of the raw material through electric strike-plating copper onto semi-finished product obtained through step 1 with a barrel, and next, a third step to form a second copper plating layer thicker than the first copper plating layer, directly on top of the first copper plating layer, through electric-plating copper with a barrel.

In an embodiment of a production method for a button or fastener member based on this invention, the mean crystal grain size of the first copper plating layer is larger than the mean crystal grain size of the second copper plating layer.

In another embodiment of a production method for a button or fastener member based on this invention, the third step starts within one minute after the second step.

In another embodiment of a production method for a button or fastener member based on this invention, the mean thickness of the first copper plating layer is 0.01-1.5 μm, while the mean thickness of second copper plating layer is 1.6-10 μm.

In a further separate embodiment of the production method for a button of fastener member based on this invention, a fourth step is further included to form a final plating layer in one layer, or two or more layers, on top of the second copper plating layer.

In a further embodiment of a production method for a button or fastener member based on this invention, the overall thickness of the final plating layer is thinner than the total thickness of the first copper plating layer and second copper plating layer.

DETAILED DESCRIPTION OF THE INVENTION

Figure 1:
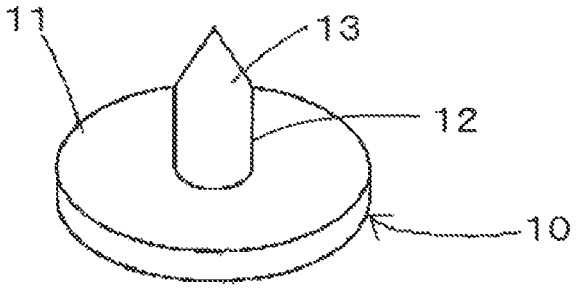
FIG. 1: An oblique drawing showing an example of a button fastener, which is a member of a snap button.

A button or fastener member based on this invention uses aluminum or an aluminum alloy as raw material. The aluminum alloy may be an aluminum-copper alloy, aluminum-manganese alloy, aluminum-silicon alloy, aluminum-magnesium alloy, aluminum-magnesium-silicon alloy, aluminum-zinc-magnesium alloy, aluminum-zinc-magnesium-copper alloy, or any other suitable aluminum alloy. Based on reasons of strength and workability, among these alloys, an aluminum-magnesium alloy, aluminum-manganese alloy or aluminum-magnesium-silicon alloy is preferred, ideally an aluminum-magnesium alloy.

A button or fastener member based on this invention involves a first copper plating layer being formed as a base plating layer directly on top of the surface of the aforementioned raw material. Since adhesion decreases if the thickness of the first copper plating layer becomes too thin, a mean thickness of 0.01 μm or more is preferred, ideally a mean thickness of 0.1 μm or more. On the other hand, since production efficiency decreases if the thickness of the first copper plating layer is too thick, a mean thickness of 1.5 μm or less is preferred, ideally a mean thickness of 1.0 μm or less.

An oxide film forms on the surface of the aluminum or aluminum alloy, so the first copper plating layer is preferably formed after appropriate pretreatment is performed by degreasing, acid washing, washing with a surfactant or water washing. The product may be formed by performing a forming process using aluminum or an aluminum alloy as raw material and a method such as die-cast forming or press-forming. Then after the semi-finished product for a button or fastener member is formed, the first copper plating layer is formed by electric strike-plating copper onto this semi-finished product with a barrel. Barrel plating eliminates the need to set material into a jig for plating, and enables mass production, unlike still plating, and furthermore, eliminates concerns of corrosion due to contact traces left during setting of the material in a jig, since there is no such setting. Barrel plating allows plating of the entire surface of the product, whereas still plating leaves the portion of the surface covered by the jig un-plated.

Commonly-known plating methods for aluminum which use barrel plating may be used for a copper strike-plating bath, and though not required, the CL-NC ALKALINE COPPER method by Uyemura & Co., Ltd. (U.S.) is one preferred method due to its adhesion to substrate surfaces, uniform adhesion, and relative superiority in smoothness and other qualities. A cyanide-free bath is used for this plating bath, which allows for direct copper strike-plating on the surface of aluminum without zincate treatment. The CL-NC ALKALINE COPPER method makes it possible to simultaneously perform removal of oxide film formed on the raw material surface and copper plating, without zincate or other base treatment. A current density of 0.3-1.2 A/dm$^2$ is preferred, ideally 0.5-1.0 A/dm$^2$. A plating bath temperature of 55-75° C. is preferred, ideally 60-70° C. A pH of 7.0-8.5 is preferred, ideally 7.0-8.0. A plating time of 30-60 minutes is preferred, ideally 40-50 minutes. A barrel speed of 2-12 rpm is preferred, ideally 4-8 rpm. Thus, it is possible to obtain a smooth plating film, which adheres to the surface of aluminum and for which swelling has been prevented.

The second copper plating layer, which is an intermediate plating layer, is formed directly on top of the first copper plating layer, with a larger thickness than the first copper plating layer. The merits of having a second copper plating layer thicker than the first copper plating layer are improved strength of the member itself, and improved durability against corrosion. In addition, the plating is smoother. Because of the high smoothness, luster is improved, and plating adhesion is improved when the top of the second copper plating layer receives an additional final plating.

A mean thickness of 1.6 μm or more is preferred for the second copper plating layer so that the aforementioned merits are fully realized, ideally a mean thickness of 2.0 μm or more. However, since production efficiency decreases if the thickness of the second copper-layer is too thick, a mean thickness of 10 μm or less is preferred, ideally a mean thickness of 5.0 μm.

Since the second copper plating layer is formed on top of the first copper plating layer, plating is even easier to achieve than on aluminum. Hence, it may be formed by various copper-plating methods known to persons skilled in the art. From the perspective of mass production, electroplating of copper with a barrel similar to the first copper plating layer is preferred. A copper cyanide bath, a copper pyrophosphate bath, a copper borofluoride bath or a sulphate bath may be used for the electric copper-plating bath. However, the formation of the second copper plating layer preferably starts within three minutes of removal from the plating equipment after formation of the first copper plating layer, and ideally starts within one minute. This is because the adhesion of the plating significantly decreases if the first copper plating layer is exposed to the air and oxidizes.

In a preferred embodiment of a button or fastener member based on this invention, the mean crystal grain size of the first copper plating layer is larger than the mean crystal grain size of the second copper plating layer. In a typical embodiment, the mean crystal grain size of the first copper plating layer is 0.7-1.1 μm, and in an even more typical embodiment, the mean crystal grain size of the first copper plating layer is 0.8-1.0 μm. In a typical embodiment, the mean grain crystal grain size of the second copper plating layer is 0.2-0.6 μm, and in an even more typical embodiment, the mean crystal grain size of the second copper plating layer is 0.3-0.5 μm.

The mean crystal grain size is found by cutting and exposing the cross section of a plating layer with a focused ion beam (FIB), and then analyzing the cross sectional structure by EBSP. Here, the boundary of crystals for which the crystal misorientation exceeds 10° is defined as the grain boundary, with mean values computed based on the cutting method (See e.g., Japanese Industrial Standard JIS G0051:2005).

Various final platings may be applied on top of the second copper plating layer as needed. The final plating layer may be one layer, or two or more. The final plating layer may be a copper-tin alloy plating or a nickel-plating layer, for example, or a combination thereof. The final plating layer may be formed by any commonly-known method, but barrel plating is preferred due to the reasons described above. Furthermore, the time for forming a final plating layer is not specified, and the plating process may be started about two or three days after removal from the plating equipment after formation of the second copper plating layer.

The final plating layer should be thinner than the total thickness of the first copper plating layer and second copper plating layer from the perspective of cost. In addition, the final plating layer ought to be thin from the perspective of preventing cracks in the plating. Specifically, the overall thickness of the final plating layer is preferably about 20-60% the total thickness of the first copper plating layer and second copper plating layer, ideally about 30-55%. The mean thickness of the final plating layer overall is preferably 5.0 μm or less, ideally 3.0 μm or less. However, since the intermediate plating layer will be exposed and risk promoting corrosion if the final plating layer overall is too thin, a mean thickness of 1.0 μm or more is preferred, ideally 1.5 μm.

In this manner, it is possible to assemble a button or fastener by a commonly-known means, using a button or fastener member obtained after plating of a raw material surface has been completed. Although not specified, some possible button members include the button fastener (referred to as a rivet) and button fastened to cloth by a button fastener shown in FIGS. 1-4. Buttons include ones that can be open and closed through holes in clothes (consisting of caps and bodies wherein said caps are covered), ones having male engaging members or female engaging members that can be open and closed by engaging and disengaging them (referred to as snap buttons) and ones used for reinforcing or decorating sewn parts of clothes such as shown in FIGS. 1-4. In addition, sometimes the button fasteners have caps to cover their bases in order to improve appearance. In addition, button fasteners are not limited to those shown in FIGS. 1-4, and may have multiple projections projecting from ring-shaped bases, or form stapler needle-like shapes by bending both edges of square flat metal sheets, for example. Fastener members may be sliders (body and/or pull tab) or fastener elements, which may be top-stopping or bottom-stopping.

FIG. 1 shows an oblique view of an example of a button fastener 10, which is a button member. The button fastener 10 has a projection 12 projecting concentrically through the middle of the disk-shaped base 11. The outer diameter of the projection 12 has tip 13 assuming a conical shape due to gradually shrinking as it approaches the tip. This button member may be fastened as reinforcement or a decoration of a sewn part of clothes.

Figure 2:
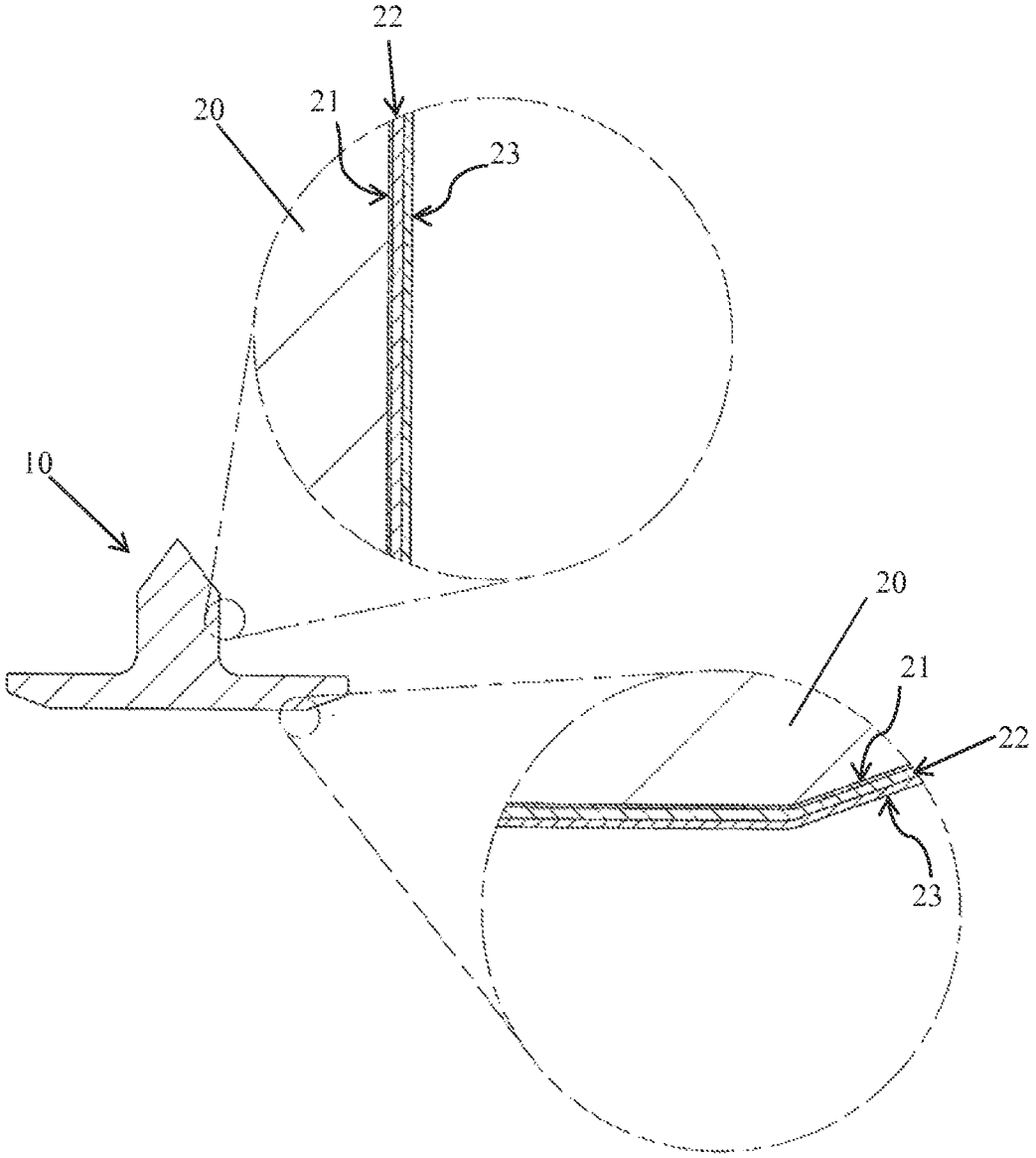
FIG. 2: A cross sectional drawing of the button fastener in FIG. 1 and partial enlarged views thereof.

Referring to FIG. 2, a cross sectional drawing is shown of the aforementioned button fastener 10. The areas surrounded by the dotted lines are partial enlarged views showing the schematics of the surface plating structure of the button fastener 10. The aforementioned button fastener 10 may consist of an aluminum or aluminum alloy raw material 20, with a first copper plating layer, second copper plating layer and final plating layer sequentially formed on the entire surface thereof. FIG. 2 shows the first copper plating layer 21, second copper plating layer 22 and the final plating layer 23. The final plating layer here is a copper-tin alloy plating layer 22. The thickness of the copper-tin alloy plating layer 23 is thinner than the combination of the first copper plating layer 21 and the second copper plating layer 22.

Figure 3:
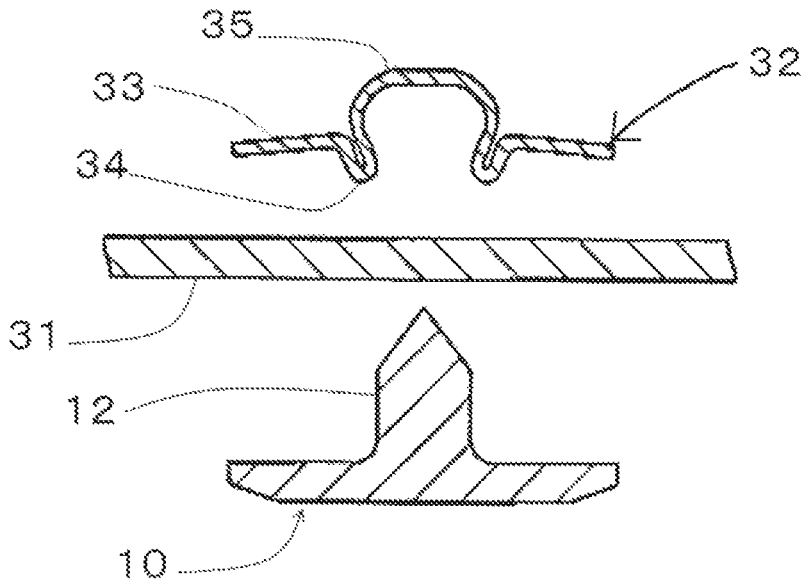
FIG. 3: A cross sectional drawing showing the button fastener in FIG. 1 prior to fastening the button to cloth.

FIG. 3 is a cross sectional drawing showing the aforementioned button fastener 10 prior to fastening a metal button 32 to a cloth 31, with the button 32 illustrated opposing the button fastener 10 with the cloth 31 interposed between. The button 32 comprises a roughly disk-shaped base 33 curving slightly towards the cloth 31, a ring-shaped convex part 34 formed in the middle of the base 33, and a concave part 35 concentrically formed inside of the ring-shaped convex part 34.

Figure 4:
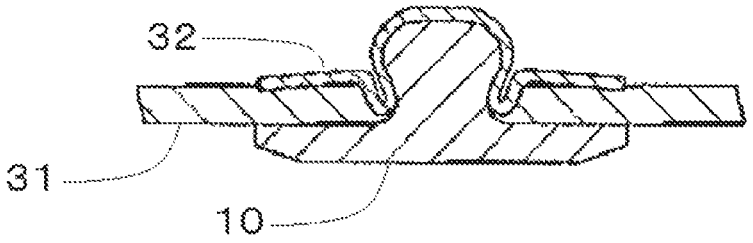
FIG. 4: A cross sectional drawing showing the button fastened to cloth.

We will explain the procedure for fastening the button 32 to the cloth 31. First, the projection 12 of the button fastener 10 is passed through the cloth 31, and inserted into the concave part 35 of the button 32. Next, the projection 12, by being pressed against the bottom part of the concave part 35, plastically deforms so that it fills the space inside of the concave part 35, and finally the projection 12 and concave part 35 engage as shown in FIG. 4. By doing so, the button 32 is fixed to the cloth 31. In this embodiment, the button fastener 10 has a plating structured based on the invention, though it may be the button 32 that has a plating structured based on the invention.

Figure 5:
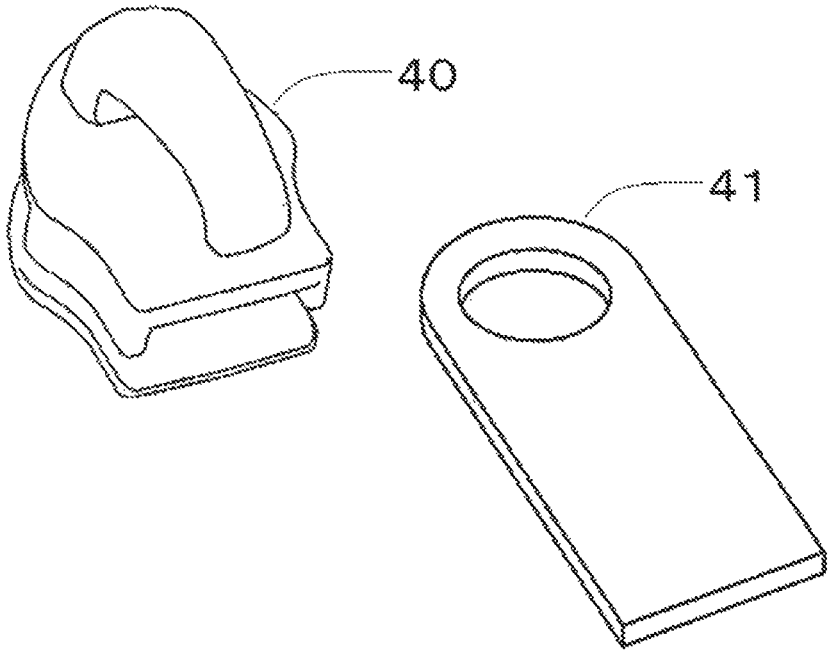
FIG. 5: An oblique drawing of a slider body and pull tab for a slider fastener based on an embodiment of this invention.

In addition, as shown by the oblique drawing in FIG. 5, a plating structured based on the invention may be adopted for the slider body 40 and pull tab 41 of the slider fastener.

EXAMPLE

One hundred test product aluminum button fasteners with the shape shown in FIG. 1 were prepared. Each button fastener had a base diameter of approximately 7.6 mm and a projection length of approximately 6.5 mm. These were pretreated using the CL-NC ALKALINE COPPER pretreatment procedure provided by Uyemura & Co., Ltd. which provided alkali degreasing for each button fastener, water washing, nitric acid activation, and water washing. Next, a copper strike-plating bath was prepared according to the CL-NC ALKALINE COPPER procedure provided by Uyemura & Co., Ltd. and the entire surfaces of the test products were barrel-plated. Plating conditions were as follows.

Plating time: 45 minutes
Barrel speed: 6 rpm
Current density: 0.5 A/dm$^2$
Plating bath temperature: 65° C.
pH: 7.5

The test products removed from the plating equipment were water-washed and dried. When the thickness of the strike copper-plating film obtained (first copper plating layer) was measured for one arbitrary test product by observing the cross-section with a scanning transmission electron microscope (STEM), the mean was 0.5 μm. In addition, the test product showed no peeling of plating, and the plating film had been formed with a uniform thickness. The mean crystal grain size of the first plating layer was 0.8 μm when measured by the method described above. About 10 more test products were measured, but they had largely the same mean thickness and mean crystal grain size.

The measurement procedure for the thickness of the first copper plating layer is as follows. After cutting and exposing the plating layer cross section with a focused ion beam (FIB), it was observed in 10000× magnified STEM images, and the thickness of the first copper plating layer was measured at 10 arbitrary points, with the mean value for the 10 points constituting the thickness of the first copper plating layer of one test product. Furthermore, in this embodiment, although STEM images were used, SEM images are also acceptable.

Next, electric copper plating was performed on each test product under the following conditions. Plating conditions were as follows. Electric copper plating was started within one minute of removal from plating equipment in order to form the first copper plating layer.

Plating bath: Copper cyanide plating NaCn (12 g/L), CuCn (65 g/L)
Plating time: 60 minutes
Barrel speed: 6 rpm
Current density: 0.5 A/dm$^2$
Plating bath temperature: 50° C.
pH: 12

The test products removed from the plating equipment were water-washed and dried. When the thickness of the copper plating film obtained (second copper plating layer) was measured for one arbitrary test product by observing the cross-section with a scanning transmission electron microscope, the mean was 4 μm. In addition, the test product showed no peeling of plating, and the plating film had been formed with a uniform thickness. In other words, a plating film had been directly formed between the plating film and aluminum surface without any intermediate. The mean crystal grain size of the second plating layer was 0.4 μm when measured by the method described above. About 10 more test products were measured, but they had largely the same mean thickness and mean crystal grain size.

The measurement procedure for determining the thickness of the second copper plating layer is described next. After cutting and exposing the plating layer cross section with a focused ion beam (FIB), it was observed in 10000× magnified STEM images, and the total thickness of the first copper plating layer and second copper plating layer was measured at 10 arbitrary points, with the mean value for the 10 points constituting the total thickness of the first copper plating layer and second copper plating layer of one test product. The value obtained by deducting the mean thickness of the first copper plating layer obtained beforehand from this mean value was the measurement value for the thickness of the second copper plating layer.

Next, electric copper-tin plating was performed on each test product under the following conditions. Plating conditions were as follows.

Plating bath: Copper cyanide tin plating F.KCN (50 g/L), KOH (30 g/L), Cu (7.5 g/L), Sn (30 g/L), Zu (0.4/L)

Plating time: 30 minutes

Barrel speed: 6 rpm

Current density: 0.5 A/dm$^2$

Plating bath temperature: 65° C.

pH: 13 or more

The test products removed from the plating equipment were water-washed and dried. When the thickness of the copper-tin plating film obtained (final plating layer) was measured for one arbitrary test product by observing the cross-section with a scanning transmission electron microscope, the mean was 2 μm. In addition, the test product showed no peeling of plating, and the plating film had been formed with a uniform thickness. About 10 more test products were measured, but they had largely the same mean thickness and mean crystal grain size.

The measurement procedure for the thickness of the final plating layer is explained next. After cutting and exposing the plating layer cross section with a focused ion beam (FIB), it was observed in 10000× magnified STEM images, and the total thickness of the first copper plating layer, second copper plating layer and final plating layer was measured at 10 arbitrary points, with the mean value for the 10 points constituting the total thickness of the first copper plating layer, second copper plating layer and final plating layer of one test product. The value obtained by deducting the mean thickness of the first copper plating layer and the mean thickness of the second copper plating layer obtained beforehand from this mean value was the measurement value for the thickness of the final plating layer.

After final plating, the test products were evaluated by comparing strength (strength when testing removal from cloth after fastening to cloth with a fastening machine), plating adhesion, luster, and corrosion resistance against a conventional product in the areas of strength, plating adhesion, luster and corrosion resistance.

Strength refers to the strength seen when the button 32 has been fastened to a button fastener 10 with the cloth 31 interposed between by a fastening machine (as shown in FIG. 4), a test device grasps the button 32 while holding onto the cloth 31, pulls up in a direction away from the cloth 31 (upward in the drawing), and the button 32 is removed from the cloth 31.

Plating adhesion is found through a primary adhesion test and secondary adhesion test.

The primary adhesion test is an evaluation of the adhesion of the plating layer of a plated part (test product) to the surface of a raw material (See e.g., Japanese Industrial Standard JIS-K-5600-5-6). Using a cutting knife, penetrate the plating layer on top of a plated test product, and make incisions reaching the surface of the raw material in a grid pattern. Attach adhesive tape on top of this grid, and evaluate the clinging of the plating layer when peeled. The secondary adhesion test is an evaluation of the adhesion of the plating layer of a plated part (test product) after boiling water treatment of the surface of a raw material. A plated test product is treated for 30 minutes in boiling water and cooled, followed by penetration with a cutting knife and making an X-shaped incision reaching the surface of the raw material, attaching adhesive tape on top of this X-shaped incision, and then evaluating the clinging of the plating layer when peeled.

Luster is evaluated by comparing appearance against a standard part.

Corrosion resistance involves using a salt spray testing machine to spray a part (test product) with a neutral 5% concentration aqueous solution of sodium chloride for a prescribed time under fixed atmospheric conditions, followed by cleaning, and observing the changes in appearance (See e.g., Japanese Industrial Standards JIS-Z-2371, JIS-H-8502, JIS-K-5600).

The results are shown in Table 1. The results in the table are the mean values at the time 10 test products were measured. The results of the comparison are also summarized below.

Strength: The strength achieved was the same as conventional products (brass).

Plating Adhesion: The adhesion achieved was the same as conventional products (brass) during both the primary adhesion test and secondary adhesion test.

Luster: The luster achieved was the same as conventional products (brass).

TABLE 1

| No. | Strength | Plating Adhesion | Luster | Corrosion Resistance |
|---|---|---|---|---|
| Example 1 | Based on results of fastener testing with a fastening machine, | Plating adhesion the same as Comparative Example 1 for both primary | Luster same as Comparative Example 1 | Based on results of salt spray test, corrosion resistance was same as |

TABLE 1-continued

| No. | Strength | Plating Adhesion | Luster | Corrosion Resistance |
|---|---|---|---|---|
| | fastening strength was same as Comparative Example 1 | adhesion test and secondary adhesion test | | Comparative Example 1 |
| Comparative Example 1 | Good | Good | Good | Good |

*In Comparative Example 1, copper plating (same as the second copper plating layer in Example 1) was formed on top of the surface of raw material, wherein the raw material was a copper alloy (brass).

Although this invention has been described in detail with reference to the drawings, the invention is not limited to the aforementioned embodiments, and various modifications are possible as long as they are within the scope of the invention.

What is claimed is:

1. A button or fastener member, comprising:

a button or fastener member formed of aluminum or an aluminum alloy;

a first copper plating layer directly covering an entire surface of the button or fastener member formed of aluminum or an aluminum alloy; and a second copper plating layer directly covering the first copper plating layer, wherein the second copper plating layer is thicker than the first copper plating layer, wherein a mean crystal grain size of the first copper plating layer is 0.7 μm-1.1 μm and a mean crystal grain size of the second copper plating layer is 0.2 μm-0.6 μm.

2. The button or fastener member of claim 1, wherein a mean thickness of the first copper plating layer is 0.01-1.5μm, and a mean thickness of the second copper plating layer is 1.6-10 μm.

3. The button or fastener member of claim 1, wherein a final plating layer covers the second copper plating layer.

4. The button or fastener member of claim 3, wherein an overall thickness of the final plating layer is thinner than a total thickness of the first copper plating layer and the second copper plating layer.

5. The button or fastener member of claim 1, further comprising a final plating layer covering the second copper plating layer, wherein the final plating layer is a copper-tin alloy plating, a nickel-plating layer, or a combination thereof and wherein an overall thickness of the final plating layer is 20%-60% of a total thickness of the first copper plating layer and the second copper plating layer.

6. A method for producing a button or fastener member according to claim 1, the method comprising:

forming a semi-finished member from aluminum or an aluminum alloy;

forming the first copper plating layer directly over surfaces of the semi-finished member by electric strike-plating copper onto the surfaces using barrel plating; and forming the second copper plating layer directly over the first copper plating layer through electric-plating copper using a barrel.

7. The method of claim 6, wherein a mean crystal grain size of the first copper plating layer is larger than a mean crystal grain size of the second copper plating layer.

8. The method of claim 6, wherein forming a second copper plating layer starts within one minute after conclusion of the forming of the first copper plating layer.

9. The method of claim 6, wherein the mean thickness of the first copper plating layer is 0.01-1.5μm, and the mean thickness of the second copper plating layer is 1.6-10μm.

10. The method of claim 6, further comprising:

forming a final plating layer on top of the second copper plating layer.

11. The method of claim 6, wherein an overall thickness of the final plating layer is thinner than a total thickness of the first copper plating layer and the second copper plating layer.

12. The method of claim 6, further comprising:

pretreating the semi-finished member prior to forming a first copper plating layer on the semi-finished member by degreasing, acid washing, washing with a surfactant or water washing the semi-finished member.

13. The method of claim 12, wherein pretreating the semi-finished member and forming a first copper plating layer are performed within a single barrel.

* * * * *